US005899638A

United States Patent [19]

Pallini, Jr.

[11] Patent Number: 5,899,638

[45] Date of Patent: May 4, 1999

[54] FLOATING PLATFORM TOP CONNECTOR

[75] Inventor: Joseph W. Pallini, Jr., Tornball, Tex.

[73] Assignee: ABB Vetco Gray Inc., Houston, Tex.

[21] Appl. No.: 08/937,061

[22] Filed: Sep. 24, 1997

Related U.S. Application Data

[60] Provisional application No. 60/027,491, Sep. 27, 1996.

[51] Int. Cl.[6] ..... E02D 5/54

[52] U.S. Cl. ..... 405/224; 405/203; 405/223.1; 403/369; 285/320; 166/350

[58] Field of Search ..... 405/196, 198, 405/223.1, 224.1, 224.2, 224.3, 224.4, 195.1, 203; 285/123.3, 320; 114/294, 297; 166/338, 350, 367, 368; 403/321, 369

[56] References Cited

U.S. PATENT DOCUMENTS

| | | | |
|---|---|---|---|
| 4,433,859 | 2/1984 | Driver et al. | 285/320 X |
| 4,516,795 | 5/1985 | Baugh | 285/320 X |
| 4,526,406 | 7/1985 | Nelson | 285/320 X |
| 4,871,282 | 10/1989 | Jennings | 405/203 X |
| 5,020,942 | 6/1991 | Pallini, Jr. | 405/224 |
| 5,244,313 | 9/1993 | Pallini et al. | 405/223.1 |
| 5,265,917 | 11/1993 | Hitz | 285/320 X |
| 5,522,681 | 6/1996 | Palini, Jr. | 405/223.1 |

*Primary Examiner*—Tamara Graysay
*Assistant Examiner*—Jong-Suk Lee
*Attorney, Agent, or Firm*—James E. Bradley

[57] ABSTRACT

A segmented ring forms a set of latches for a tendon top connector on a floating platform. The latches reside in a housing and have either a groove or thread profile on an upper internal surface. The grooves interface with a mating groove profile on the tendon. The latches rotationally pivot backward and forward from the outer portion of the bottom surface. When the latches are forward, the profile in the internal surface engages the mating profile of the tendon top joint. When the latches are swung out, these profiles clear and permit the top joint to pass through the connector. Retraction of the latches is provided by application of force on the inside surface of an annular extension on the outer portion of the latches. This force can be provided by a variety of actuators. This top connector allows for passive dynamic engagement of the connector to the tendon top joint. When the latches are permitted to move inward, contact is made with the mating profile on the tendon top joint. Downward movement of the tendon relative to the connector causes the passing profile of the top joint to engage the profile of the latches and engage the latches into the top joint. Upward movement of the tendon relative to the connector causes the latches to be pivoted out of the way, allowing the top joint to pass through the connector unrestricted.

32 Claims, 4 Drawing Sheets

FLOATING PLATFORM TOP CONNECTOR

This application claims benefit of Provisional App. 60/027,491 filed Sep. 27, 1996.

TECHNICAL FIELD

This invention relates in general to top connectors for floating platforms and in particular to an improved tendon and riser top connector for a tension leg platform.

BACKGROUND ART

The concept described in this disclosure is primarily used for connection of a mooring tendon to the hull of a tension leg platform. However, this concept also has use for attachment of drilling or production risers of any type of floating platform (TLP, Spar, etc.) to the riser tensioning or support system on the platform. Both of these systems must make an attachment of a top tubular member to the platform support structure and provide for adjustment in overall length of the tendon or riser.

Previous systems have typically made use of some form of slip segments that had a threaded or grooved interface to the top joint of the tendon. These slip segments typically slide down the taper, or slide and rotate in combination to engage the tendon top section. These systems have used either elaborate internal drive systems and/or actuation tools to engage and disengage the connector on and off of the tendon top joint. In addition, these systems have either required the tendon to be statically restrained or substantially over-tensioned and then relieved for engagement.

DISCLOSURE OF INVENTION

The concept described in this disclosure is based on a segmented ring that forms a set of latches. These latches reside in a housing and have either a thread or groove profile on the upper internal surface. The grooves interface with a mating groove profile in the tendon top joint. These latches rotationally pivot backward and forward from the outer portion of the bottom surface. When the latches are forward, the profile in the internal surface engages the mating profile of the tendon top joint. When the latches are swung out, these profiles clear and permit the top joint to pass through the connector. The latches utilize either weight, spring force or a combination thereof to move the latches inward. Retraction of the latches is provided by application of force on the inside surface of an annular extension on the outer portion of the latches. This force can be provided by a variety of actuators which may be hydraulically or mechanically operated.

The concept described in this disclosure allows for passive dynamic engagement of the connector to the tendon top joint. When the latch segments are permitted to move inward, contact is made with the mating profile on the tendon top joint. Downward movement of the tendon top joint relative to the connector (or hull of the TLP) causes the passing profile of the top joint to engage the profile of the latches and engage the latches into the top joint. Upward movement of the tendon top joint, relative to the connector, causes the latches to be pivoted out of the way, allowing the top joint to pass through the connector unrestricted. Release of the latches to allow downward movement of the top joint relative to the connector is once again accomplished by pulling the latches back out of position.

BEST MODE FOR CARRYING OUT THE INVENTION

Figure 1:
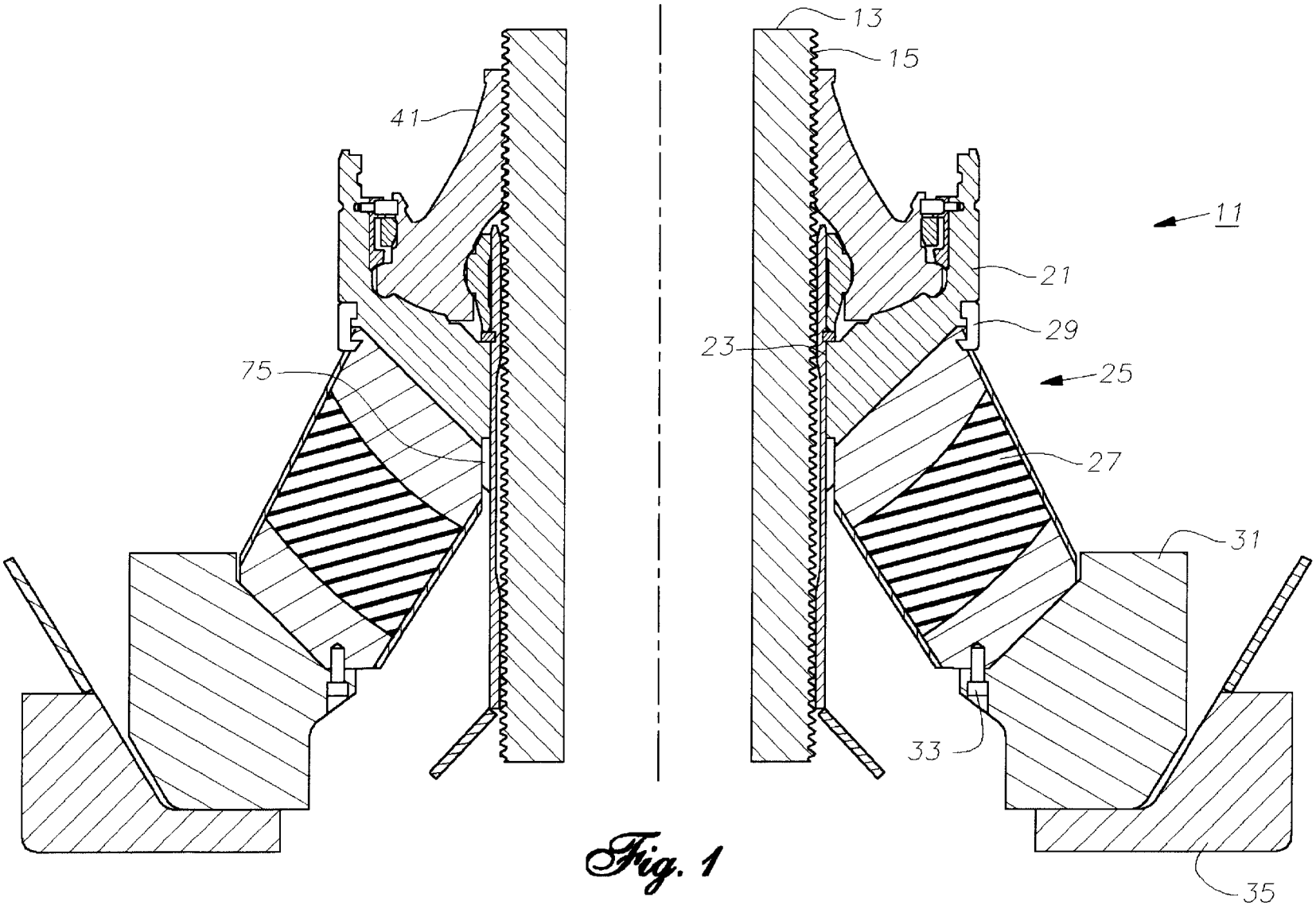
FIG. 1 is a sectional view of a top connector constructed in accordance with the invention.

Referring to FIG. 1, a top connector 11 for attachment to a top joint or upper termination of a tendon riser or tubular member 13 is shown. Top connector 11 is provided for adjusting the length of tendon 13. Tendon 13 contains a section of continuous external threads or grooves 15 at an upper termination of tendon 13. Top connector 11 is the upper end joint of the entire tendon 13 and provides the load transfer from a supporting structure into tendon 13. Top connector 11 resides in a receptacle 35 located on the platform.

Top connector 11 utilizes a cylindrical connector housing 21 to transfer loads back into the supporting structure. Housing 21 is supported at an outer lower surface by a flexible element 25 having a central elastomer 27. Flexible element 25 is secured to housing 21 with a flexible retainer 29. Housing 21 has a central cavity or bore 23 which receives tendon 13. In the embodiment shown, flexible element 25 is secured to a load flange 31 with a plurality of bolts 33. Load flange 31 is landed on receptacle 35 which is on the platform. In an alternate embodiment, housing 21 may be connected directly to a load bearing surface on the platform or tensioning device.

Figure 2:
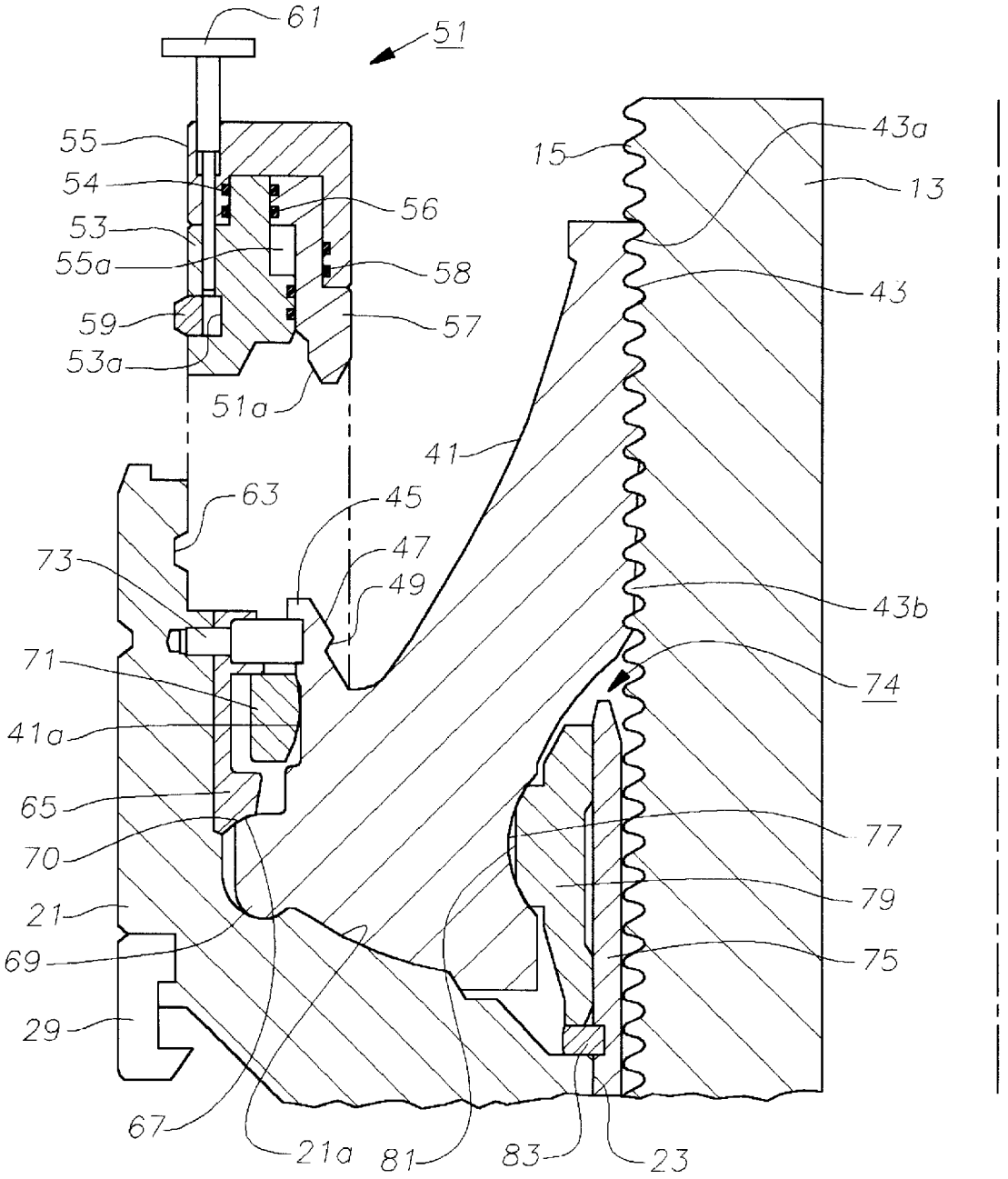
FIG. 2 is an enlarged sectional view of an actuation tool for the top connector of FIG. 1.
Figure 3:
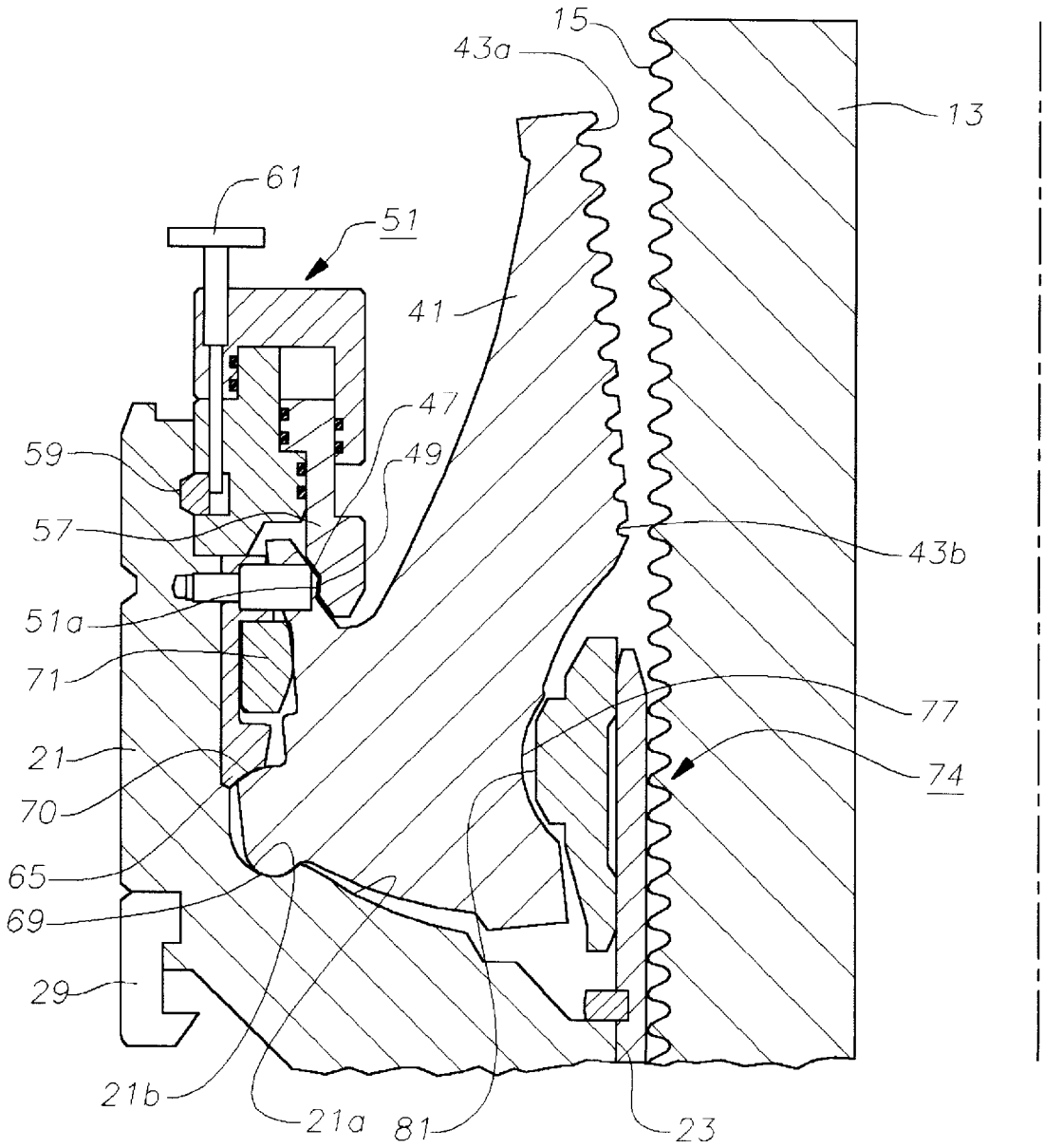
FIG. 3 is a partial sectional view of the top connector of FIG. 1 in the retracted position.

Referring to FIG. 2, a plurality of latches 41 are carried in bowl 21*a* of housing 21. Latches 41 contain a thread or groove profile 43 on their upper inner surface which interfaces with grooves 15 on tendon 13. Grooves 43 are tapered generally in a convex profile with larger, deeper grooves 43*a* at the top and smaller, shallower grooves 43*b* on a lower side (FIG. 3). Grooves 15, however, are of uniform depth. When top connector 11 is engaged into the thread or groove profile 15 of tendon 13, the loads pass from tendon 13 into latches 41, through housing 21, and into the support structure.

Latches 41 rotationally pivot in housing 21 on their outer bottom surfaces. Latches 41 engage grooves 15 when latches 41 pivot inward as shown in FIG. 2, and disengage when they pivot or rock outward as shown in FIG. 3. The lower surface of latches 41 engage a mating load surface or bowl 21*a* in housing 21 when latches 41 are in the engaged position. A protruding rib 69 on the bottom of each of latches 41 engages a recess or mating pivot member groove 21*b* at an outer edge of bowl 21*a*. The lower side of rib 69 forms a pivot point for each latch 41. Latches 41 are forced inward by weight, a spring force or a combination of the two.

Latches 41 have a vertically extending outer arm or rim 45 on an outer portion. When sufficient force is exerted on an inner surface or taper 47 of rim 45, latches 41 are pivoted back about ribs 69, thereby retracting latches 41 and disengaging them from tendon 13. The preferred configuration of taper 47 of rim 45 is to have an upward facing surface at the top and a slightly reversed, downward facing tapered surface 49 just below.

This configuration allows an actuation device 51 to use a lower profile 51*a* that is reversed from that of tapers 47, 49. A variety of actuation devices may be used to apply a force for this purpose. When the force is removed, latches 41 are again forced into contact with grooves 15 of tendon 13.

Actuation tool 51 cams-back the extended rim 45 of latches 41, thereby retracting them. When actuation tool 51 engages far enough such that cam or profile 51*a* and tapers 47, 49 engage (FIG. 3), the closing force of latches 41 holds the two mating profiles together, thus keeping latches 41 in the retracted position.

In the embodiment shown, actuation tool 51 comprises a main body 53, an upper body 55 and seals 54 therebetween. A cavity 55*a* is defined between main body 53 and upper body 55. An annular piston 57 slidingly reciprocates within cavity 55*a* and is sealed to main body 53 with seals 56 and to upper body 55 with seals 58. Actuating tool 51 has a split latch ring 59 which is radially moveable relative to actuating tool 51. Latch ring 59 is mounted in an outer lower surface or recess 53*a* in main body 53. Actuating tool 51 is latched to a recess 63 in housing 21 by a set of pins 61. Pins 61 are vertically or axially moveable within bodies 53, 55 to engage latch ring 59.

When latches 41 are first engaged into tendon 13, it is very unlikely that the mating grooves of each piece will align. However, as top connector 11 moves downward relative to tendon 13, grooves 43 will gradually engage grooves 15 until the load surfaces of the two profiles come into contact. The angle of the load surface is shallower than the angle at which grooves 43 are approaching grooves 15. This causes grooves 15 to first capture grooves 43*b* before grooves 43*a* (FIG. 3). As tension load is applied to tendon 13, grooves 43*a* are set deeper than grooves 43*b* so that a small gap remains between grooves 43*b* and grooves 15 (FIG. 2). Therefore, latches 41 pivot inward until the stab flanks of grooves 43 come into contact and provide a balancing force. This configuration ensures that latches 41 will always set themselves under load.

The stab flanks of grooves 43 are of a sufficiently steep angle that tendon 13 will pivot latches 41 back out of the way as tendon 13 moves upward relative to top connector 11. In this manner, tendon 13 is passively restrained from passing down through connector 11, but is unrestrained from passing up through connector 11. This permits dynamic lock-offs of connector 11 relative to tendon 13.

Latches 41 are held in place by an annular retainer 65 that attaches to an inner surface of housing 21 just above rib 69 of latches 41. The bottom of retainer 65 has a spherical surface 67 which mates with an upward facing shoulder 70 above rib 69. Shoulder 70 and rib 69 are curved and generally convex, thereby allowing the lower portion of rib 69 to act as an arcuate pivot point. An inward-biased split ring 71 is housed in an inner portion of retainer 65 and is used to provide supplemental engagement force to latches 41. Split ring 71 contacts an outer wall 41*a* of each latch 41 to urge them inward. A set of keeper pins 73 are installed between retainer 65 and housing 21. Keeper pins 73 also pass through slots in latches 41 and prevent each latch 41 from rotating about the axis of tendon 13.

In an alternate configuration (not shown), pins 73 do not engage or extend into these slots. Instead, actuation tool 51 contains pins that engage these slots. In this latter configuration, actuation tool 51 is provided as a means for rotating latches 41 relative to the longitudinal axis of tendon 13. With threaded latches 41, this provides the ability to make continuous adjustment of the position of connector 11 relative to tendon 13.

A synchronizer 74 having a guidance sleeve 75 is attached to tendon 13 at bore 23 of housing 21. The bore of sleeve 75 is only slightly larger in diameter than the outside of tendon 13. This allows sleeve 75 to provide close-centered, angular alignment with tendon 13. In FIG. 3, connector 11 is shown prior to alignment with tendon 13. A lower inner surface 77 of latches 41 is partially spherical and concave and engaged by a convex mating profile 81 on a synchronizer ring 79. Ring 79 is free to slide up and down on the upper outside surface of sleeve 75. Synchronizer 74 ensures that the movement of each latch 41 is timed with the others as they engage tendon 13. A retainer ring 83 at the base of housing bowl 21*a* provides a lower stop for ring 79.

Top connector 11 is assembled by resting flexible element 25 on housing 21 with housing 21 upside down, and attaching flexible element 25 by installing flexible element retainer 29. Guide sleeve 75 is then passed through housing 21. Split retainer ring 71 is then expanded and slid into place over the top of sleeve 75 and into the groove of the outside of sleeve 75.

To install latches 41, a lifting clamp (not shown) is attached to rims 45 around latches 41. Latches 41 are then lifted and synchronizer 74 is slid into the bottom of latches 41 and placed into position. The latches/synchronizer combination is then lowered into housing 21 (that is not uprighted), and the lifting clamp is removed. Split ring 71 is collapsed and then inserted into its groove in retainer 65. Retainer 65 and spring 71 are then inserted to housing 21 and attached in place by installing keeper pins 73. The assembly is then lowered into load flange 31 and attached to it by installing bolts 33.

Figure 4:
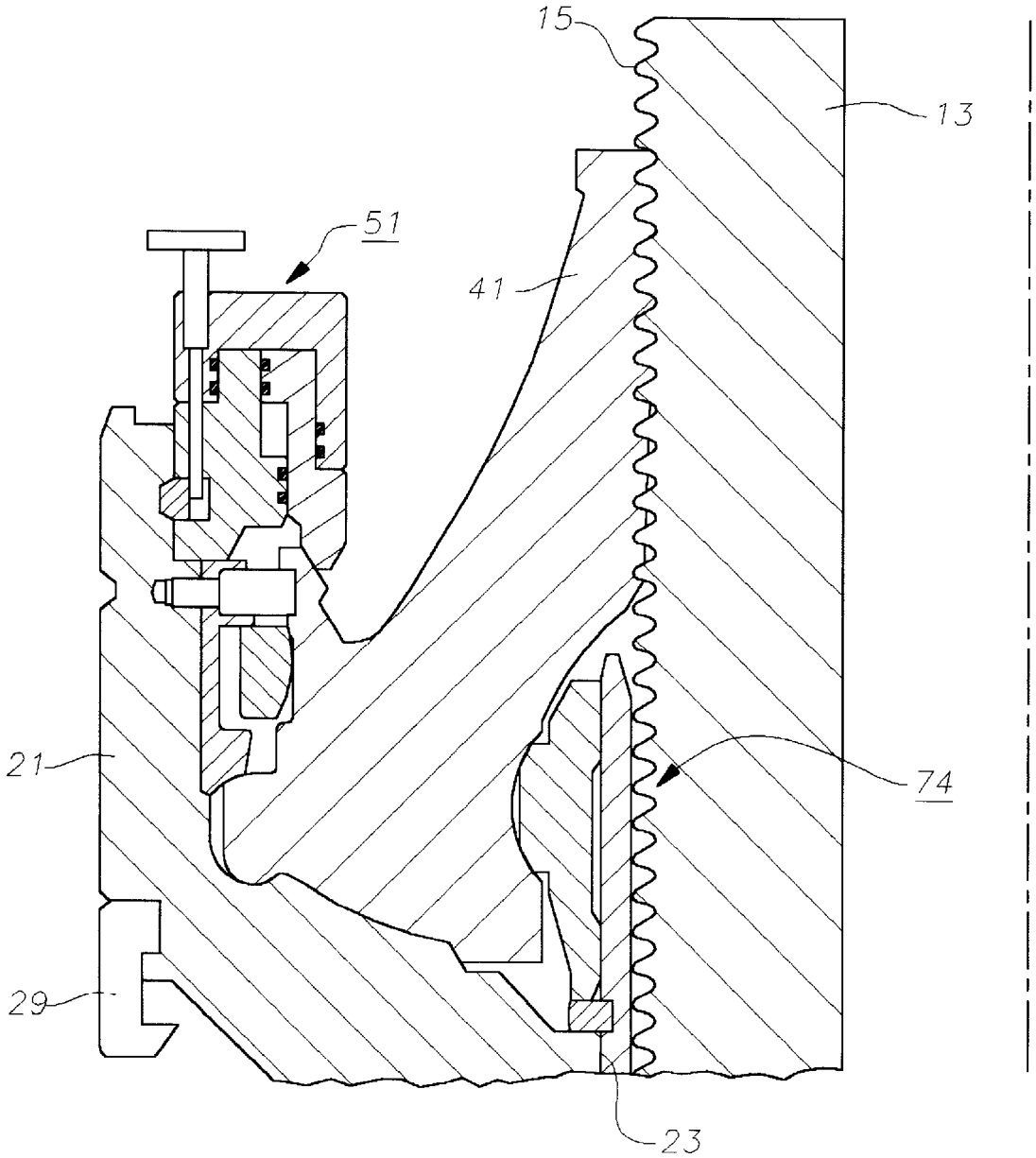
FIG. 4 is a partial sectional view of the top connector of FIG. 1 in the engaged position with the actuation tool engaging the top connector.

In operation, actuation tool 51 is installed and hydraulic pressure is applied to it to move piston 57 downward. The downward movement of piston 57 causes latches 41 to pivot or rock outward. Latches 41 are held in a retracted position by actuation tool 51 as shown in FIG. 3. Ballast is added to the vessel which moves top connector 11 downward relative to tendon 13. When connector 11 is at its generally desired elevation relative to tendon 13, the hydraulic pressure is relieved. Spring 71 then forces latches 41 to rock forward. Latches 41 are held from engagement by crest-to-crest contact of grooves 15 and 43. This condition can occur when tendon 13 is either moving downward relative to the connector 11 and engaging latches 41, or moving upward relative to latches 41 and pivoting them out of engagement. FIG. 4 shows latches 41 fully engaged to tendon 13. After installation, pin 61 is lifted to retract latch ring 59 back into recess 53*a* so that actuation tool 51 can be removed from connector 11. Latches 41 keep top connector 11 from moving upward relative to tendon 13.

The invention has several advantages. Rocking latches and a simple actuation tool are used to engage and disengage the connector on and off of the tendon top joint; an elaborate internal drive system is not required. This invention also eliminates the need to statically restrain or substantially overtension the tendon for engagement.

While the invention has been shown in only some of its forms, it should be apparent to those skilled in the art that it is not so limited, but is susceptible to various changes without departing from the scope of the invention.

I claim:

1. An apparatus for engaging a member which has external grooves, the member being adapted for extending from a floating structure toward the sea floor and for being under axial loads, the apparatus comprising:

a housing for receiving the member, the housing being adapted to be carried on the floating structure; and a set of latches, each of the latches having a set of grooves for mating with the grooves on the member, each of the latches being carried on pivot points formed between the housing and the latches, the latches being pivotal about the pivot points from a disengaged position wherein the grooves of the latches are retracted from the grooves of the member to an engaged position wherein the grooves of the latches are for engagement with the enternal grooves of the member so that axial loads in the member transfer through the latches to the housing.

2. The apparatus of claim 1, further comprising synchronizer means in engagement with profiles provided on inner sides of the latches for synchronizing the pivotal movement of the set of latches.

3. The apparatus of claim 1, further comprising a spring member on an outer side of the set of latches above the pivot points for biasing the set of latches to the engaged position.

4. The apparatus of claim 3 wherein the spring member comprises a split ring.

5. The apparatus of claim 1, further comprising an actuator mountable to the housing in engagement with each of the latches, the actuator being movable between first and second positions for pivotally moving the set of latches from the engaged position to the disengaged position, and for selectively retaining the set of latches in the disengaged position.

6. The apparatus of claim 1 wherein the set of grooves on each of the latches tapers in a convex profile with larger, deeper grooves at the top of the latches and smaller, shallower grooves on a lower side of the latches.

7. The apparatus of claim 1, further comprising a pin located between each of the latches and the housing for preventing the set of latches from rotating relative to the housing about a longitudinal axis of the housing.

8. The apparatus of claim 1, further comprising a retainer located between the housing and an outer wall portion of each of the latches above the pivot points for limiting upward movement of the set of latches relative to the housing.

9. The apparatus of claim 1, wherein the housing has a recess and the pivot point of each of the latches comprises a rib which protrudes from each of the latches and pivotally engages the recess in the housing.

10. The apparatus of claim 1, wherein each of the latches has an arm located above the pivot point; and wherein the apparatus further comprises:

an actuator mountable to the housing having a contacting portion which engages the arm and is movable from a first position to a second position, and when in the second position, the contacting portion pivots the latches to the disengaged position.

11. The apparatus of claim 1, further comprising a synchronizer for synchronizing the pivotal movement of the set of latches; the synchronizer comprising:

a synchronizing ring having a convex outer side; and wherein each of the latches has a concave profile on an inner side which engages the convex outer side of the synchronizing ring.

12. The apparatus of claim 1, further comprising a synchronizer for synchronizing the pivotal movement of the set of latches; the synchronizer comprising:

a guide sleeve located within the housing for receiving the member;

a synchronizing ring carried on the guide sleeve and movable along an axis of the guide sleeve, the synchronizing ring having a convex outer side; and wherein each of the latches has a concave profile on an inner side which engages the convex outer side of the ring.

13. The apparatus of claim 1, wherein the housing has an axial cavity through which the member is adapted to extend, and wherein the pivot points are located radially outward from the grooves of the latches.

14. An apparatus for engaging a member which has external grooves, the member being adapted for extending from a floating structure toward the sea floor and for being under axial loads, the apparatus comprising:

a housing having an axis and an axial cavity for receiving the member, the housing being adapted to be carried on the floating structure;

a set of latches carried by the housing, each of the latches having a set of grooves on an inner side for mating with the enternal grooves on the member, each of the latches having a load transferring surface radially outward from the grooves;

the housing having a mating load transferring surface radially outward from the cavity for engagement by the load transferring surfaces of the latches; and the latches being pivotal relative to the housing about pivot points from a disengaged position wherein the grooves of the latches can be retracted from the enternal grooves of the member to an engaged position wherein the grooves of the latches are for engagement with the enternal grooves of the member, and the load transferring surfaces of the latches contact the mating load transferring surfaces in the housing for transferring axial loads from the member through the latches and to the housing, the pivot points being located radially outward from the load transferring surfaces of the housing and the latches.

15. The apparatus of claim 14, further comprising a spring member on an outer side of the set of latches above the pivot points for biasing the set of latches to the engaged position.

16. The apparatus of claim 14 wherein the set of grooves on each of the latches tapers in a convex profile with larger, deeper grooves at the top of the latches and smaller, shallower grooves on a lower side of the latches.

17. The apparatus of claim 14 wherein the pivot points comprise a recess in the housing and a protruding rib on each of the latches which pivotally engages the recess in the housing.

18. The apparatus of claim 14 wherein each of the latches has an arm; and wherein the apparatus further comprises:

an actuator mountable to the housing having a contacting portion which engages the arm and is movable from a first position to a second position, and when in the second position, the contacting portion pivots the latches to the disengaged position.

19. The apparatus of claim 14, further comprising a synchronizer surrounding the cavity for synchronizing the pivotal movement of the set of latches; the synchronizer comprising:

a guide sleeve located within the cavity for receiving the member; and a synchronizer ring carried on the guide sleeve and movable along the axis of the housing, the synchronizer ring having a convex outer side; and wherein each of the latches has a concave profile on an inner side which engages the convex outer side of the ring.

20. An apparatus for engaging a member which has external grooves, the member being adapted for extending from a floating structure toward the sea floor and for being under axial loads, the apparatus comprising:

a housing having an axis and an axial cavity for receiving the member, the housing being adapted to be carried on the floating structure;

a set of latches carried by the housing, each of the latches having a set of grooves on an inner side for mating with the enternal grooves on the member, each of the latches having a downward facing load transferring surface radially outward from the grooves;

the housing having a mating load transferring surface radially outward from the cavity and facing upward for engagement by the load transferring surfaces of the latches;

each of the latches having a pivot point member which engages a mating pivot point member in the housing, the pivot point members being located radially outward from the load transferring surfaces of the housing and the latches, the latches being pivotal about the pivot point members from a disengaged position wherein the grooves of the latches are retracted from the grooves of the member to an engaged position wherein the grooves of the latches are for engagement with the enternal grooves of the member and the load transferring surfaces of the latches contact the mating load transferring surfaces in the housing for transferring axial loads from the member through the latches and to the housing; and a retainer mounted to the housing above the pivot point members of the latches for preventing substantially any upward movement of the pivot point members of the latches relative to the housing.

21. The apparatus of claim 20 wherein the pivot point member of the housing comprises a recess, and the pivot point member of each of the latches comprises a protruding rib which engages the recess.

22. The apparatus of claim 20 wherein each of the latches has an arm located above the pivot point member of each of the latches, each of the arms having an inward facing surface; and wherein the apparatus further comprises:

an actuator which engages the arm, the actuator having a cam which engages the inward facing surface of the arm and is movable from an upper position to a lower position, the cam pivoting the latches to the disengaged position when in the lower position.

23. An apparatus for engaging a member which has external grooves, the member being adapted for extending from a floating structure toward the sea floor and for being under axial loads, the apparatus comprising:

a housing having an axis and an axial cavity for receiving the member, the housing being adapted to be carried on the floating structure;

a plurality of latches carried by the housing, each of the latches having grooves on an inner side for mating with the enternal grooves on the member, each of the latches having a downward facing load transferring surface radially outward from the grooves;

the housing having a mating load transferring surface radially outward from the cavity and facing upward for engagement by the load transferring surfaces of the latches;

each of the latches having a pivot point member which engages a mating pivot point member in the housing, the pivot point members being located radially outward from the load transferring surfaces of the housing and the latches, the latches being pivotal about the pivot point members from a disengaged position wherein the grooves of the latches can be retracted from the enternal grooves of the member to an engaged position wherein the grooves of the latches are in for engagement with the enternal grooves of the member and the load transferring surfaces of the latches contact the mating load transferring surfaces in the housing for transferring axial loads from the member through the latches and to the housing;

a retainer mounted to the housing above the pivot point members of the latches for preventing substantially any upward movement of the pivot point members of the latches relative to the housing;

an arm located on each of the latches and positioned relative to the pivot member on each of the latches so that outward movement applied to the arm pivots the latch to the disengaged position; and an actuator mountable to the housing in engagement with the arm for selectively holding the latches in the disengaged position.

24. The apparatus of claim 23, wherein the actuator has a cam which engages the arm of the latches between first and second positions to cause the movement of the latches from the engaged position to the disengaged position.

25. The apparatus of claim 23, further comprising a pin located between each of the latches and the housing for preventing the latches from rotating relative to the housing about the axis of the housing.

26. The apparatus of claim 23 wherein the grooves on each of the latches tapers in a convex profile with larger, deeper grooves at the top of the latches and smaller, shallower grooves on a lower side of the latches.

27. The apparatus of claim 23 wherein the pivot point member of the housing comprises an upward facing recess, and the pivot point member of each of the latches comprises a protruding rib which pivotally engages the recess in the housing.

28. The apparatus of claim 23, further comprising a spring member on an outer side of the latches above the pivot point members of the latches for biasing the latches to the engaged position.

29. The apparatus of claim 23, further comprising a synchronizer surrounding the cavity and in engagement with profiles provided on inner sides of the latches for synchronizing the pivotal movement of the latches.

30. A method for engaging a tubular member which extends from a floating platform toward the sea floor and has external grooves at an upper termination, the method comprising:

(a) mounting a housing on the floating platform which has a set of latches and a bore for receiving the upper termination, each of the latches having grooves for mating with the grooves on the upper termination, the latches being pivotally carried on lower ends by the housing;

(b) rotationally pivoting the latches to a disengaged position wherein the set of latches retract pivotally away from the upper termination; and when at the desired position, (c) rotationally pivoting the latches to an engaged position wherein the grooves of the latches engage the external grooves on the upper termination.

31. The method of claim 30, further comprising synchronizing the pivotal movement of the latches.

32. The method of claim 30, further comprising biasing the latches to the engaged position.

* * * * *